US009550550B1

(12) United States Patent
Housman

(10) Patent No.: US 9,550,550 B1
(45) Date of Patent: Jan. 24, 2017

(54) TOW ROPE TERMINAL SECTION WITH CLIMB-ABOARD PROVISIONS

(71) Applicant: Eric T. Housman, Paducah, KY (US)

(72) Inventor: Eric T. Housman, Paducah, KY (US)

( * ) Notice: Subject to any disclaimer, the term of this patent is extended or adjusted under 35 U.S.C. 154(b) by 0 days.

(21) Appl. No.: 14/741,963

(22) Filed: Jun. 17, 2015

Related U.S. Application Data

(60) Provisional application No. 62/013,123, filed on Jun. 17, 2014.

(51) Int. Cl.

| | |
|---|---|
| ***B63B 35/73*** | (2006.01) |
| ***B63B 21/56*** | (2006.01) |
| ***B63B 27/14*** | (2006.01) |
| ***B63B 21/04*** | (2006.01) |

(52) U.S. Cl.
CPC ..... *B63B 27/146* (2013.01); *B63B 21/045* (2013.01); *B63B 21/56* (2013.01)

(58) Field of Classification Search
CPC ..... B63B 35/73
USPC ..... 114/253
See application file for complete search history.

(56) References Cited

U.S. PATENT DOCUMENTS

| | | | | |
|---|---|---|---|---|
| 175,019 A | | 3/1876 | Borgfeldt | 441/35 |
| 1,456,168 A | | 5/1923 | Witmer et al. | 441/40 |
| 2,270,437 A | | 1/1942 | Herendeen | 114/362 |
| 2,651,789 A | | 9/1953 | Newland | 114/362 |
| 2,764,766 A | | 10/1956 | Boyle et al. | 441/38 |
| 3,021,917 A | * | 2/1962 | Holt | B63B 35/85 182/129 |
| 3,035,286 A | | 5/1962 | Brill | 441/37 |
| 3,216,030 A | * | 11/1965 | Garfield | B63C 9/26 134/169 A |
| 3,411,166 A | | 11/1968 | Kimmel | 441/65 |
| 4,014,057 A | * | 3/1977 | Kuojarvi | B63C 9/26 114/190 |
| 4,194,257 A | | 3/1980 | Martin et al. | 441/115 |
| 4,572,330 A | * | 2/1986 | Langevin | B63B 27/14 114/362 |
| 4,723,929 A | | 2/1988 | Parish | 441/39 |
| 4,789,045 A | * | 12/1988 | Pugh | A62B 1/20 114/362 |
| 5,074,236 A | * | 12/1991 | Robertson | B63B 27/14 114/362 |
| 5,083,955 A | * | 1/1992 | Echols | B63B 35/815 114/253 |
| 5,094,405 A | * | 3/1992 | Brum | B64D 3/02 114/247 |
| 5,152,245 A | * | 10/1992 | Olsen | E06C 1/56 114/362 |
| 5,287,945 A | * | 2/1994 | Thurlow | B63B 7/085 114/362 |
| 5,427,557 A | * | 6/1995 | Lunden, Sr. | B63C 9/32 180/319 |
| 5,540,178 A | * | 7/1996 | Damron | B63B 27/14 114/362 |

(Continued)

*Primary Examiner* — Lars A Olson
*Assistant Examiner* — Jovon Hayes
(74) *Attorney, Agent, or Firm* — Jonathan A. Bay

(57) ABSTRACT

A tow-rope terminal section for watersports is provided for attachment to the end a tow rope and forming a final link to the inner tube or whatever inflated or floating towable. The tow-rope terminal section is provide with climb-aboard provisions so that fallen riders can climb back aboard the towable more easily.

20 Claims, 3 Drawing Sheets

(56) References Cited

U.S. PATENT DOCUMENTS

| | | | | |
|---|---|---|---|---|
| 5,542,369 | A * | 8/1996 | Ingram | B63C 9/00 114/347 |
| 5,860,766 | A * | 1/1999 | Lochtefeld | A63B 69/0093 114/253 |
| 5,979,351 | A * | 11/1999 | Fleischman | B63B 35/73 114/253 |
| 6,860,774 | B2 * | 3/2005 | Lintzner | B63B 35/817 441/69 |
| 7,306,501 | B2 | 12/2007 | Pierce, Jr. et al. | 441/83 |
| 7,458,334 | B2 * | 12/2008 | Baker | B63B 27/146 114/343 |
| 7,585,197 | B1 * | 9/2009 | Merten | B63C 9/26 182/136 |
| 7,586,197 | B2 * | 9/2009 | Lee | H01L 23/53238 257/762 |

* cited by examiner

TOW ROPE TERMINAL SECTION WITH CLIMB-ABOARD PROVISIONS

CROSS-REFERENCE TO PROVISIONAL APPLICATION(S)

This application claims the benefit of U.S. Provisional Application No. 62/013,123, filed Jun. 17, 2014, the disclosure of which is incorporated herein by this reference thereto.

BACKGROUND AND SUMMARY OF THE INVENTION

The invention relates to watersports and, more particularly, to the terminal section of a tow rope, as for towing an inner tube or other inflated towable and the like (ie., a towable) for tubers (ie., pleasure riders) to ride on, wherein such terminal section of said tow rope is provided with climb-aboard provisions so that fallen tubers can climb back aboard the towable more easily.

A number of additional features and objects will be apparent in connection with the following discussion of the preferred embodiments and examples with reference to the drawings.

BRIEF DESCRIPTION OF THE DRAWINGS

There are shown in the drawings certain exemplary embodiments of the invention as presently preferred. It should be understood that the invention is not limited to the embodiments disclosed as examples, and is capable of variation within the scope of the skills of a person having ordinary skill in the art to which the invention pertains. In the drawings.

DETAILED DESCRIPTION OF THE PREFERRED EMBODIMENTS

Figures 1, 2:
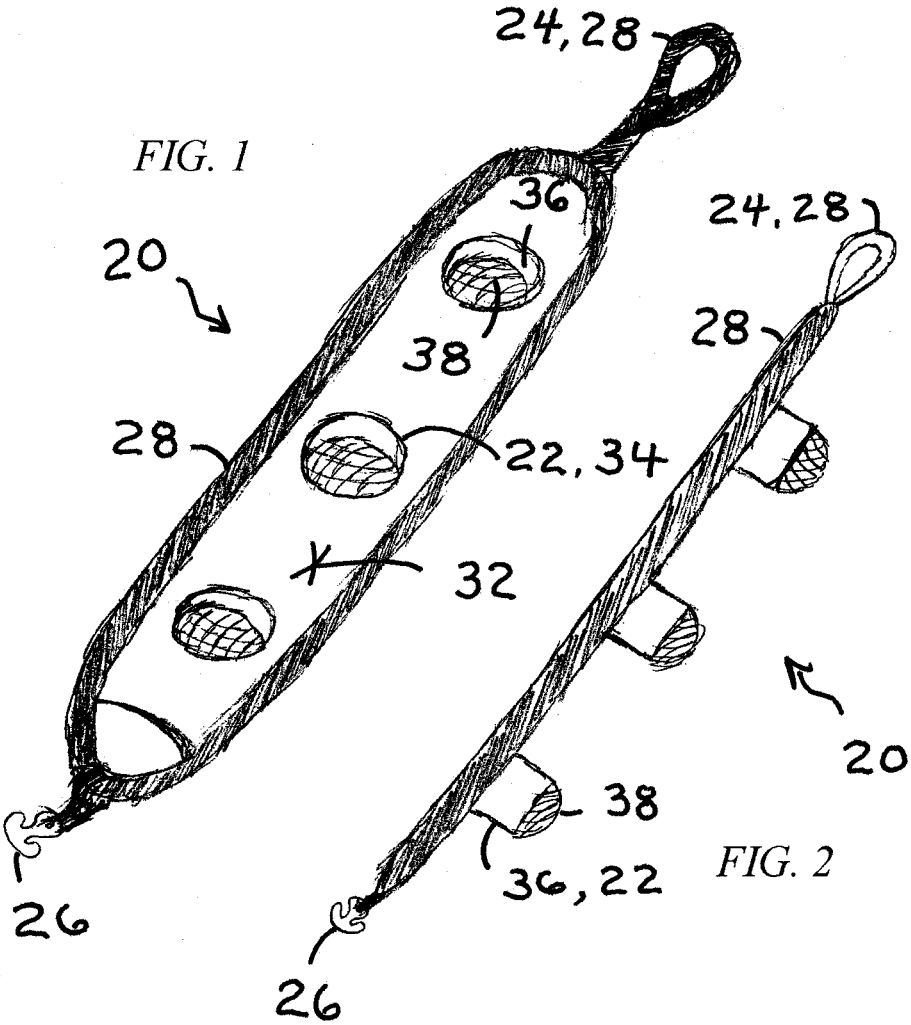
FIG. 1 is a perspective view of a terminal section of a tow rope in accordance with the invention, and which is provided with climb-aboard provisions in accordance with the invention.
FIG. 2 is a side elevational view thereof.

FIGS. 1 and 2 show a terminal section 20 of a tow rope in accordance with the invention which is provided with climb-aboard provisions 22 in accordance with the invention.

The tow rope terminal section 20 in accordance with the invention might be anywhere from between (and without limitation) about three and nine feet in length (eg., one to three meters). The tow rope terminal section 20 extends axially between a loop end 24 and a T-headed cleat 26. The tow rope terminal section 20 is preferably constructed of a rope frame 28 which forms an axially elongated rectangle (albeit with rounded ends), with one end of which is fashioned into the loop end 24, and the other end is tied to and secures the T-headed cleat 26. The rope of the rope frame 28 can comprise and without limitation large diameter nylon rope. Preferably ¾ths inch to 1¼ths inch (~19 mm to ~32 mm) diameter rope is used. However, anywhere between ⅜ths to 1¾ths inch (~10 mm to ~45 mm) diameter rope would be readily usable as well.

The interior of the elongated frame 28 is filled in with an axially elongated panel 32 of fabric or flexible material, such as and without limitation nylon canvas. The panel 32 is preferably secured to the rope frame 28 by stitching or the like. The axially elongated panel 32 is formed with a series of axially-spaced rung-provisions 22, inasmuch as the rung-provisions 22 serve both as hand-holds and foot stirrups, even if the rung-provisions 22 do not appear anything like ladder rungs. That is, while the inventive rung-provisions 22 do not look like ladder rungs, the inventive-rung provisions 22 serve a similar function, and regardless of differences in appearances therefrom.

Preferably the rung-provisions 22 comprise an opening 34 formed in the panel 32, which opening 34 is surrounded by a periphery of tough nylon strap material 36. Preferably the fabric panel 32 and the nylon strap material 36 are joined at one edge of the nylon strap material 36 by a stitched seam. Hence the nylon strap material 36 kind of forms the rung-provision 22 into a flexible well for a user to clench by a first or insert a foot like into a stirrup. Thus the strap material 36 serves as the sidewall (eg., 36) of the well.

If the nylon strap material 36 is reckoned as a soft-sided sidewall (eg., 36) of a well relative to the panel 32, the nylon strap material 36 can furthermore be reckoned as having an open top end in the plane of the panel, and a bottom end 38. The bottom end 38 might optionally be closed by a nylon mesh material or the like. That way, a user can not inadvertently stick his or her whole arm or whole leg through the opening 34 for the rung-provision 22 in the panel 32. That is because, the mesh bottom 38 prevents that. However, the mesh bottom 38 also provides ample drainage for the rung-provision 22 such that, as being formed in the shape of a shallow well, the rung-provision 22 is one well that does not hold water.

Figure 3:
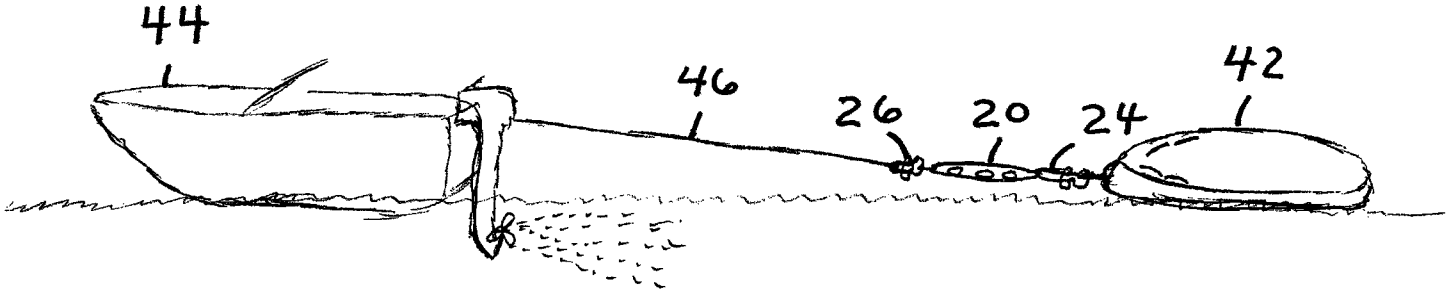
FIG. 3 is a reduced scale, side perspective view showing the tow rope terminal section of FIGS. 1 and 2 spliced between a main section of a tow rope and an inflated towable in accordance with the prior art, wherein the tow rope is coupled to a tow boat and the tow boat is moving at speed, pulling a combined prior art tow rope and tow-rope terminal section in accordance with the invention taut, and hence towing the inflated towable.
Figure 4:
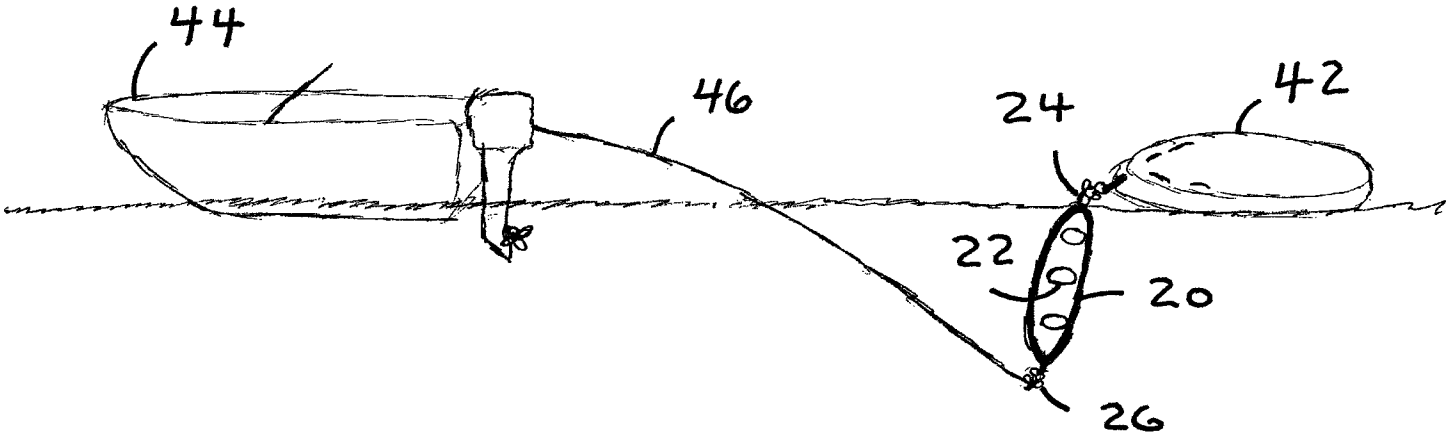
FIG. 4 is a side perspective view comparable to FIG. 3 except showing the boat and the inflated towable at a stand still, wherein the prior art tow rope and tow-rope terminal section in accordance with the invention have fallen slack.

FIGS. 3 and 4 show a preferred manner of use of the tow rope terminal section 20 in accordance with the invention. The inspiration behind the invention is to provide tubers (ie., pleasure riders on top of inner tubes or like inflated towables 42) with climb-aboard provisions 22 to conveniently climb aboard the towable 42. Some towables 42 have a riding surface which is quite high off the water. In other cases, some towables 42 are sought to be boarded by rather small tubers. Additionally, since there is often a lot of falling off of an inflated towable 42, the chore of children climbing back on aboard and then back on aboard again, is repeated nearly endlessly.

It is an object of the invention to give such tubers a means of clamoring back on aboard the towable 42 more easily. FIG. 3 shows a tow boat 44 pulling a main section of a tow rope 46. The tow rope terminal section 20 in accordance with the invention is spliced between the tag end of the main tow rope 46 and the and the inflated towable 42 in accordance with the prior art. The tow boat 44 is moving at speed, pulling the tow rope 46/20 taut, and hence towing the inflated towable 42.

FIG. 4 shows the tow boat 44 and the inflated towable 42 at a stand still, and the tow rope slack 46/20. This is the state of things when a crew is trying to load their first tuber onto the inflated towable 42, or when a fallen tuber is trying to re-board the inflated towable 42.

It is an aspect of the invention that the T-headed cleat 26 for the tow rope terminal section 20 in accordance with the invention is metallic and/or otherwise dense and weighty. The weight of the T-headed cleat 26 sinks the tow rope terminal section 20 in accordance with the invention into a semi-vertical angle of repose. The counterpart T-headed cleat on the prior art towable 42 is likely to made or polyethylene, or some like plastic with a density about the same as water. In other words, a plastic T-headed cleat of the prior art would not sink the tow rope terminal section 20 in accordance with the invention at all, and certainly not as nearly as well a chunky metal one like T-headed cleat 26. Accordingly, it is an object of the invention to form the T-headed cleat 26 from such material or materials so as to readily sink the tow rope terminal section 20 in accordance with the invention in a nearly vertical angle of repose as shown in FIG. 4. Needless to say, the T-headed cleat 26 functions as a coupler. However, it is less significant that this coupler 26 is indeed a T-headed cleat as it is more important that the coupler 26 sinks the tow rope terminal section 20 like as shown in FIG. 4. This vertical (to nearly vertical) axis of repose axially spaces out the rung provisions 22 along a vertical or steep axis which is more natural for tubers to climb up.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A tow rope terminal section for a floating watersports towable, comprising:

climb-aboard provisions for a user to step upon and climb aboard the floating towable;

a metallic weighted T-headed cleat;

wherein one end of the tow-rope terminal section is fashioned into a loop end adapted for securing to a towable; and the other end secures the weighted metallic T-headed cleat which is adapted to secure to the terminal end of the tow rope;

whereby at a stop, the combined tow rope and tow-rope terminal section fall slack, with the weighted metallic T-headed cleat sinking that end of the tow-rope terminal section down, and thereby stretching the tow-rope terminal section toward a vertical angle of repose, for better utilization by users as a climb-aboard assistant.

2. The tow rope terminal section of claim 1, wherein:

tow rope terminal section extends axially between a loop end and a T-headed cleat.

3. The tow rope terminal section of claim 1, further comprising:

a rope frame which forms an axially elongated frame extending between spaced ends, wherein the climb-aboard provisions are hung from the rope frame.

4. The tow rope terminal section of claim 3, wherein:

the axially elongated frame generally comprises a rectangular shape terminating in rounded ends.

5. The tow rope terminal section of claim 4, wherein:

one end of the rope frame is fashioned into a loop end, and the other end is adapted to secures a T-headed cleat.

6. The tow rope terminal section of claim 5, wherein:

the rope frame has length measuring between three and nine feet (~one to ~three meters) in length.

7. The tow rope terminal section of claim 6, wherein:

the rope frame comprises a large diameter rope having a diameter between ¾ths inch to 1¾ths inch (~19 mm to ~45 mm) in diameter.

8. A tow rope terminal section for a floating watersports towable, comprising:

climb-aboard provisions for a user to step upon and climb aboard the floating towable;

a rope frame which forms an axially elongated frame extending between spaced ends, wherein the climb-aboard provisions are hung from the rope frame; and an axially-elongated panel of flexible material wherein said axially-elongated rope frame defines an open interior which is substantially filled in by said axially elongated panel of flexible material, wherein the climb-aboard provisions are formed in or on the axially-elongated flexible panel.

9. The tow rope terminal section of claim 8, wherein:

said axially-elongated flexible panel comprises nylon canvas.

10. The tow rope terminal section of claim 8, wherein:

said axially-elongated flexible panel is secured to the rope frame by stitching.

11. The tow rope terminal section of claim 8, wherein:

said climb-aboard provisions comprise a series of axially-spaced rung-provisions formed by the axially-elongated flexible panel, whereby the rung-provisions serve at least as foot steps.

12. The tow rope terminal section of claim 11, wherein:

the rung-provisions are formed as a series of openings formed in the panel.

13. The tow rope terminal section of claim 12, further comprising:

strap material for surrounding the periphery of each opening, thereby providing strength against tearing.

14. The tow rope terminal section of claim 13, wherein:

the flexible panel comprises synthetic canvas material and the strap material comprises synthetic strap material joined to flexible panel by stitched seams.

15. The tow rope terminal section of claim 13, wherein:

the strap material for each rung-provision forms a generally-cylindrical elongated sidewall extending between an open proximal end and spaced distal end, wherein the open proximal end is secured to the flexible panel about the periphery of the respective opening, and said strap material comprises flexible material thereby forming a flexible foot stirrup.

16. The tow rope terminal section of claim 15, wherein:

said strap material of each of the rung-provisions as formed in generally-cylindrical elongated sidewalls has the open proximal end thereof secured to and in the plane of the flexible panel, and the distal end is formed closed whereby the rung provisions serves as hand-holds and foot steps and the closed distal end disallows a user from inadvertently sticking his or her whole arm or whole leg through the rung provision.

17. The tow rope terminal section of claim 16, wherein:

the closed-ended rung-provisions for an open-ended well, and said strap material for the rung provisions comprises a mesh material that allows for the drainage of water from the open-ended wells that are the rung provisions.

18. The tow rope terminal section of claim 16, further comprising:

a closure for the distal end of the rung-provisions provided with ventilation for the drainage of water out of the rung provisions.

19. The tow rope terminal section of claim 18, wherein: the closure comprises a mesh material.

20. The tow rope terminal section of claim 11, further comprising:

a metallic weighted T-headed cleat, wherein one end of the rope frame is fashioned into a loop end adapted for securing to a towable, and the other end secures the weighted metallic T-headed cleat which is adapted to secure to the terminal end of the tow rope whereby at a stop, the combined tow rope and tow-rope terminal section fall slack, with the weighted metallic T-headed cleat sinking that end of the tow-rope terminal section down, and thereby stretching the tow-rope terminal section toward a vertical angle of repose, for better utilization by users as a climb-aboard assistant.

* * * * *